United States Patent [19]

Wadkinson, Jr.

[11] 4,228,848

[45] Oct. 21, 1980

[54] LEAK DETECTION FOR COAXIAL HEAT EXCHANGE SYSTEM

[75] Inventor: George W. Wadkinson, Jr., Old Bethpage, N.Y.

[73] Assignee: Grumman Energy Systems, Inc., Bohemia, N.Y.

[21] Appl. No.: 5,804

[22] Filed: Jan. 23, 1979

[51] Int. Cl.[3] ..... F28D 7/10

[52] U.S. Cl. ..... 165/11 R; 165/70; 165/134 R; 165/156

[58] Field of Search ..... 165/11, 70, 134, 140, 165/141, 154, 156

[56] References Cited

U.S. PATENT DOCUMENTS

| | | | |
|---|---|---|---|
| 703081 | 1/1954 | GBX . | |
| 813,918 | 2/1906 | Schmitz | 165/141 |
| 2,316,273 | 4/1943 | Meyer et al. | 165/141 |
| 2,578,550 | 12/1951 | Holm et al. | 165/141 |
| 2,703,701 | 3/1955 | Simpelaar | 165/141 |
| 2,706,620 | 4/1955 | Graves | 165/156 |
| 2,847,193 | 8/1958 | Carter | 165/141 |
| 2,893,701 | 7/1959 | Bell | 165/70 |
| 2,903,495 | 9/1959 | Dickson et al. | 165/11 |
| 3,173,196 | 3/1965 | Grimm | 165/141 |
| 3,521,704 | 7/1970 | Bridegum | 165/70 |
| 3,537,513 | 11/1970 | Austin et al. | 165/140 |
| 3,566,957 | 3/1971 | Bridegum | 165/70 |
| 3,830,290 | 8/1974 | Thamasett et al. | 165/70 |
| 3,907,026 | 9/1975 | Mangus | 165/70 |
| 4,014,735 | 3/1977 | Guth et al. | 165/140 |
| 4,054,981 | 10/1977 | Bridegum | 165/70 |

FOREIGN PATENT DOCUMENTS

| | | | |
|---|---|---|---|
| 1183757 | 7/1959 | France | 165/156 |
| 71127 | 10/1959 | France | 165/141 |
| 703081 | 1/1954 | United Kingdom | 165/70 |
| 748264 | 4/1956 | United Kingdom | 165/70 |
| 804592 | 11/1958 | United Kingdom | 165/11 |
| 1145513 | 3/1969 | United Kingdom | 165/70 |

*Primary Examiner*—Sheldon Richter

*Attorney, Agent, or Firm*—Mellor A. Gill

[57] ABSTRACT

A system having a tube-in-tube heat exchanger comprising three coaxial tubular members fitted one within the other with manifolding at each longitudinal end of the exchanger for the circulation of fluid through the outside tubular member in a counterflow direction to fluid passing through the inside tubular member such that heat is exchanged therebetween. A fluid is provided in the intermediate tubular member such that a leak in either the outer or inner tubular members can be detected. Each of the tubular members has integral radially inwardly projecting fins in its bore, the fins of the outer member being in good thermal contact with the intermediate member whose fins, in turn, are in good thermal contact with the inner member such that an effective heat flow path therebetween is provided.

2 Claims, 1 Drawing Figure

10
12
14
16
18
20
22
24
26
28
30
32
34
36
38
40
42
44
46
48
50
52
54
56
58
60
62
64
68
70
72
74
76
78
80
82
84
86
88
90
92
94
96
98
100
102
104
106
108
112
114
116
118
120

LEAK DETECTION FOR COAXIAL HEAT EXCHANGE SYSTEM

BACKGROUND OF THE INVENTION

1. Field of the Invention

The present invention relates to a tube-in-tube heat exchange system and, more particularly, to a coaxial multiple-tube system in which heat exchange between the fluids in the system is by means principally of a metal-to-metal thermal path.

2. Description of the Prior Art

The prior art shows a number of examples of tube-in-tube heat exchange systems such as the designs of L. Meyer et al. and R. H. Carter in U.S. Pat. Nos. 2,316,273 and 2,847,193, respectively, and the designs disclosed in British Pat. No. 1,145,513. Although the first two references do not incorporate leak detecting means in their systems, such means are taught in the latter reference. The prior art discloses that it is also known to incorporate leak detecting means in tube-in-shell type heat exchange systems. Such designs are disclosed by E. Thamasett et al. in U.S. Pat. No. 3,830,290 and by G. A. Plummer in British Pat. No. 804,592.

Inasmuch, however, as none of the prior art heat exchangers provide radially inwardly projecting integral fins on each of the coaxial tubular members comprising their heat exchange means as is the case in the present invention, it is seen that their efficiency suffers thereby and the metal-to-metal heat path of this invention is a novel improvement over the prior art.

SUMMARY OF THE INVENTION

This heat exchange system has a tube-in-tube heat exchanger comprising three coaxial tubular members fitted together and having a metal-to-metal contact with one another by means of longitudinally extending fins, the spaces between the fins providing room for the passage of fluids through each tube independently of the fluids passing through the spaces between the fins in the other tubes. Manifolding is provided at each longitudinal end of the heat exchanger such that fluid can be circulated through the passages in the outer tubular member preferably in a counterflow direction to fluid passing through the inside tubular member so that heat is exchanged therebetween. A fluid is provided in the intermediate tubular member and means are provided such that a leakage of fluid from either the outer or the inner tubular members can be detected. The radially inwardly projecting fins of the outer member are in metal-to-metal contact with the outer surface of the intermediate member whose fins, in turn, are in good thermal contact with the inner member such that an effective metal-to-metal heat flow path therebetween is provided. In addition, the fins of the inner tube extending radially inwardly into the flow therethrough promote heat transfer efficiency by increasing the surface area of the tube wetted by the fluid passing through the same.

The heat exchanger of this invention thus significantly enhances the heat transfer process. It is a principal object of the invention, therefore, to provide a tube-in-tube heat exchange system in which the heat path between tubes is by means of fins integrally formed in the tubes such a high thermal transfer efficiency is achieved in a reduced-diameter, compact, rugged design.

It is another object of the invention to provide a tube-in-tube heat exchanger in which the possibility of one fluid in the exchanger leaking to contaminate the other fluid passing therethrough is substantially reduced or eliminated, and in which means are provided to detect any leakage such that corrective action can be initiated.

A further object of the invention is to provide a tube-in-tube heat exchanger in which the heat transfer path between fluids in the system is by means principally of a metal-to-metal contact, which metal-to-metal contact is by fins integrally formed in the tubes themselves such that the diameter of the apparatus is reduced and the thermal efficiency thereof is enhanced.

Yet another object of the invention is to provide a tube-in-tube heat exchanger in which the heat transfer fins are integrally formed in the bores of the tubes to thereby improve the thermal efficiency of the apparatus, said fins, further, also acting to space the tubes in their concentric relationship to thereby minimize the number of parts required in the device so that the cost of materials and the complexity of the manufacturing operation are reduced.

A still further object of the invention is to provide a tube-in-tube heat exchanger in which outside connections to internal passages are made directly without traversing an intermediate space to minimize the complexity of the device and enhance the reliability of the design.

DESCRIPTION OF THE DRAWINGS

For the purpose of illustrating the invention, there is shown in the drawings the form which is presently preferred; it should be understood, however, that the invention is not necessarily limited to the precise arrangements and instrumentalities shown.

DESCRIPTION OF THE PREFERRED EMBODIMENT

Figures 1, 2:
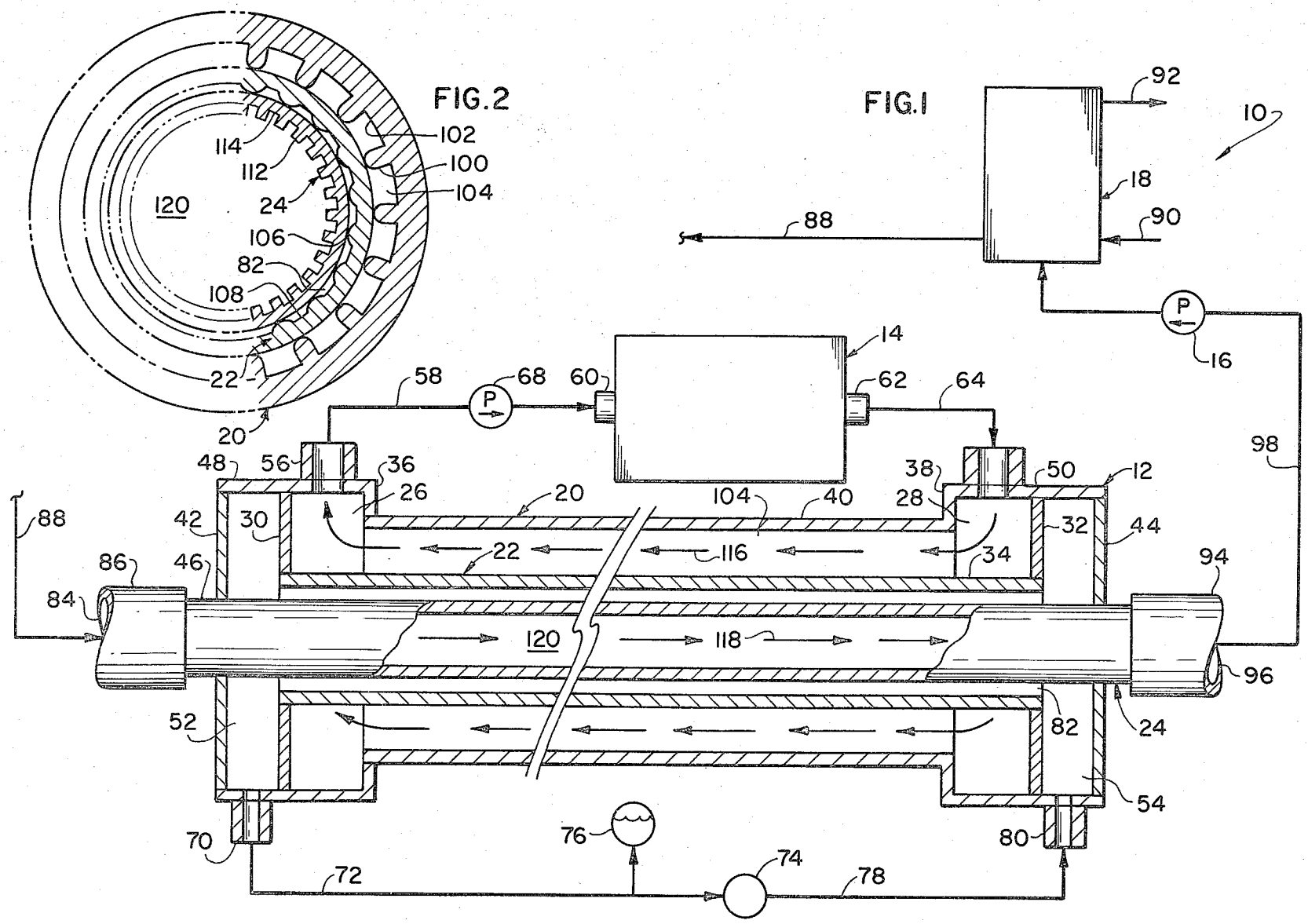
FIG. 1 is a diagrammatic view of the heat exchange system of the invention showing the heat exchanger in cross section.
FIG. 2 is a fragmentary transverse cross-sectional view of the coaxial tubular members of the heat exchanger.

Referring now to the drawings, FIG. 1 shows the heat exchange system 10 of the invention. In the system, a heat exchanger 12 is provided to transfer heat imparted to a first fluid by a solar collector 14 or other heat source to a second fluid passing through the heat exchanger, the heated fluid being circulated by suitable means such as pump 16 to a place where it is utilized or to a storage tank 18 for subsequent withdrawal for use. The heat exchanger 12 comprises an outer tubular member 20, an intermediate tubular member 22, and an inner tubular member 24 arranged one within the other preferably in a coaxial relationship. At each end of the outer member 20 is a fluid-tight manifold 26, 28 formed by disk-like end walls 30, 32 which extend transversely of the heat exchanger from the outer surface 34 of intermediate member 22 to enlarged-diameter sections 36, 38 of the outer wall 40 of the outer member 20. End walls 42, 44 extending transversely of the heat exchanger from the outer surface 46 of the inner member 24 to extensions 48, 50 of the enlarged-diameter sections 36, 38 form manifolds 52, 54 for the intermediate member 22.

The end walls are joined to their respective mating surfaces of the tubular members by any suitable means, such as by brazing, to form fluid-tight junctures.

Manifold 26 is provided with an outlet fitting 56 which is connected to pipe 58 which runs to the inlet fitting 60 of a heat source such as solar collector 14. The collector, in turn, is provided with an outlet fitting 62 connecting to pipe 64 which runs to an inlet fitting 66 opening into the manifold 28 of outer member 20. A pump 28, if required, can be installed in a suitable location in the fluid circuit such as in pipe 58 for circulating fluid between the solar collector 14 and the outer tubular member 20 of the heat exchanger.

Manifold 52 of the intermediate member 22 is provided with an outlet fitting 70 which is connected to pipe 72 which is connected to suitable detecting means such as a pressure switch 74 or a sight glass 76 or the like. The return line 78 from the detecting means is connected to an inlet fitting 80 opening into the manifold 54 of the intermediate member 22. In this design, the passages 82 of the intermediate member 22 function to detect leaks from either the outer 20 or the inner 24 tubular members. A suitable non-toxic fluid such as air or water fills passages 82 and the other volume of the detection system. As is well known in the art, the intrusion of fluid from either the inner or outer tubular members into the fluid in the detection system which would denote a leak in those members is detected at sight glass 76 or by pressure switch 74 such that corrective action can be initiated. As is also well known, in addition to the actuation of a switch by pressure or the visible rise of fluid in a sight glass, other alarm modes can include spillover from a vent, a rise of fluid between electrical contacts to actuate an electrical alarm or to shut off appropriate valves, or the sensing of a pressure rise of closed end tubes. Inasmuch as these detection means are well known in the art, it is not believed necessary to illustrate or describe herein such means nor to go into detail with respect to ancillary equipment such as electrical or electronic circuitry or detector circuits and the like associated therewith.

The inner tubular member 24 has an inlet end 84 which is provided with a suitable fitting 86 for connection with a pipe 88 through which water which is to be heated by heat exchange flows from a supply source such as storage tank 18. Storage tank 18 may be provided with an input 90 from a main and an outlet 92 to a tap or the like. A suitable fitting 94 at the outlet end 96 of the inner member is connected to a pipe 98 through which the output of the heat exchanger flows to the storage tank 18 or to any other suitable outlet for utilization.

High thermal efficiency is attained in the heat exchanger of this invention because the heat path is by means of metal-to-metal contact provided by integral fins in the bores of each of the tubular members. As best shown in FIG. 2, outer tubular member 20 has radially inwardly projecting integral fins 100 formed in the bore 102 thereof, the fins extending longitudinally the length from manifold 26 to manifold 28 of the member. Fins 100 are spaced one from the other around the circumference of the member such that fluid passages 104 are formed. Intermediate tubular member 22 has radially inwardly projecting integral fins 106 formed in the bore 108 thereof, the fins extending longitudinally the length from manifold 52 to manifold 54 of the member. Fins 106 are spaced one from the other around the circumference of the member such that previously mentioned fluid passages 82 are formed. Inner member 24 has radially inwardly projecting integral fins 112 formed in the bore 114 thereof, the fins extending longitudinally the length from fitting 86 to fitting 94 of the member. As shown, the fins 112 are spaced from one another around the circumference of the member.

The thickness of the fins 100, 106, and 112, the spacing of the same, the wall thickness of the tubular members and their radial spacing, that determine the size of the fluid passages in the heat exchanger are governed by well known thermodynamic and hydrodynamic considerations as are the materials of construction of the device. The fins themselves can be straight longitudinally or they can have a helical twist. With respect to the fabrication itself of the heat exchanger, any suitable manufacturing technique can be utilized to form the tubular members and then to insert one into the other such that the fins of the outer two members are in good thermal contact with the outer wall of the member located radially inwardly of the other.

It will be appreciated that the inner member 24 can be formed with integral radial fins not only in its bore but also radially outwardly projecting fins on its outer surface. With such construction, the intermediate member 22 would thus have integral radially outwardly projecting fins and the outer member would be merely a plain wall tube. This would be the situation also in a construction in which the intermediate member would have integral radial fins not only in its bore but also radially outwardly projecting fins on its outer surface. It will be recognized that the inner member in such construction would have fins merely in its bore as shown in the FIG. 2 embodiment. Other such combinations are feasible and are to be understood as falling within the compass of the invention.

In operation, the passages 82 and other volume of the intermediate member 22 and the leak detecting circuit associated therewith would be filled with a suitable non-toxic fluid such as water and the circuit would be nulled in accordance with the type of detector incorporated therein. Circulation of fluid from the solar collectors 14 and from the storage tank 18 is commenced as by opening suitable valves (not shown) and/or by actuating pumps 68 and 16. Fluid (depicted by arrows 116) which has been heated by solar energy in the collectors passes through pipe 64 into the manifold 28 and then travels down passages 104 in outer member 20, giving up heat as it does. This fluid then passes into manifold 26 and is returned through pipe 58 to be reheated. The fluid being heated (depicted by arrows 118) is delivered to the heat exchanger through pipe 88 and passes through the bore 120 thereof gaining heat by thermal exchange with the fluid 116 from the solar collector. This heated fluid is passed through pipe 98 to storage tank 18 for subsequent utilization. Should a leak develop in either the wall of the inner or the intermediate member, the leakage into the fluid contained in the leak detecting circuit would be detected as by a rise in the level of fluid in the sight glass 76 or the change in pressure occasioned by the leak would actuate the pressure switch 74 by well-known means (not shown) such that appropriate corrective measures may be initiated.

It will be recognized that the capacity of the system of the invention can be increased by manifolding the heat exchangers 12 in parallel. Also, performance generally improves when the heat exchangers are coiled. It should be understood that, although the heat exchange system of the invention has been described as being used with a solar collector or other heat source for heating a fluid, the system is equally effective in applications where a working fluid is being cooled. An example of such an application would be the use of the system with a conventional refrigeration machine to cool potable fluids safely and efficiently.

Although shown and described in what are believed to be the most practical and preferred embodiments, it is apparent that departures from the specific methods and apparatus described will suggest themselves to those skilled in the art and may be made without departing from the spirit and scope of the invention. I, therefore, do not wish to restrict myself to the particular instrumentalities illustrated and described, but desire to avail myself of all modifications that may fall within the compass of the appended claims.

Having thus described my invention, what I claim is:

1. In a heat exchange system:

a heat exchanger comprising at least outer, intermediate, and inner tubular members inserted one into the other and being in physical contact with one another, said outer and intermediate members having substantially longitudinally extending relieved areas in their bores that form outer and intermediate fluid passages therein, with the bore of said inner member forming a third fluid passage, the end portions of said outer tubular member having an expanded diameter with respect to the portion of said outer member intermediate said expanded end portions;

first coaxial end walls fixed at each end of said intermediate tubular member and extending transversely outwardly therefrom into a sealed relationship with the inside surface of said expanded diameter portions of said outer tubular member, second coaxial end walls spaced longitudinally outwardly of said first coaxial walls, said second walls being fixed to the outer surface of said inner tubular member and extending transversely outwardly therefrom into a sealed relationship with the inside surface of said expanded diameter portions of said outer tubular member, said end walls closing off said outer and intermediate longitudinal passages such that said fluid passages are isolated from one another and from said inner passage;

heat conducting means integrally formed in each of said tubular members, said means consisting of substantially longitudinally extending fins projecting radially inwardly, the fins of said outer member contacting the outer wall of said intermediate member, the fins of said intermediate member contacting the outer wall of said inner member such that there is a metal-to-metal heat exchange relationship between said members, each fin of said members being spaced from its adjacent fins to thus form in said outer and intermediate members said longitudinal fluid passages; inlet and outlet ports opening on said passages in said members to permit the circulation of fluid therethrough;

detector means coupled to fluid in said intermediate passages to sense a condition of said intermediate fluid that signifies a leak in one of said tubular members; and means for circulating fluid through said longitudinal passages of said outer member and through the bore of said inner member whereby heat is exchanged between the fluids.

2. The heat exchange system of claim 1 wherein said tubular members have a concentric relationship with one another.

* * * * *